United States Patent [19]

Hoel et al.

[11] 4,042,243

[45] Aug. 16, 1977

[54] PNEUMATIC SKILL GAME

[75] Inventors: Per O. Hoel, Plainsboro; Erkki Pekka Korpijaakko, Princeton; Matthew A. Moustakas, Mercerville, all of N.J.

[73] Assignee: CBS Inc., New York, N.Y.

[21] Appl. No.: 691,414

[22] Filed: June 1, 1976

[51] Int. Cl.[2] ..... A63B 71/04; A63F 9/14

[52] U.S. Cl. ..... 273/108; 273/128 R; 273/119 B; 273/DIG. 26

[58] Field of Search ..... 273/106 R, 106 E, 86 D, 273/119 B, 95 C, 148 R, DIG. 26; 124/64; 46/44

[56] References Cited

U.S. PATENT DOCUMENTS

| | | | |
|---|---|---|---|
| 1,486,313 | 3/1924 | Van Antwerp | 273/148 R |
| 1,673,945 | 6/1928 | Littlefield | 124/26 |
| 1,958,563 | 5/1934 | Brooker et al. | 273/86 D |
| 2,919,135 | 12/1959 | Marchionda | 273/119 B |
| 3,469,340 | 9/1969 | Breneman et al. | 46/44 |
| 3,658,326 | 4/1972 | Fawick | 272/68 |
| 3,685,828 | 8/1972 | Getgey et al. | 273/95 C |
| 3,820,788 | 2/1973 | Goldfarb et al. | 273/86 D |

FOREIGN PATENT DOCUMENTS

| | | | |
|---|---|---|---|
| 485,272 | 4/1949 | Canada | 273/119 B |

*Primary Examiner*—Richard C. Pinkham
*Assistant Examiner*—Lawrence Everett Anderson
*Attorney, Agent, or Firm*—Spencer E. Olson

[57] ABSTRACT

A competitive pneumatic game to be played by two persons includes a straight section of rigid, transparent tubing having compressible air bellows secured to its opposite ends and a projectile disposed within the tubing for movement therealong by air pressure in the tube. Associated with each of the bellows is a scoring indicator actuable when the projectile strikes it. The object of the game is for one player to force the projectile, by skillful manipulation of his bellows against the manipulation by his opponent of his bellows, to strike the scoring indicator at the opponent's end of the tubing.

7 Claims, 4 Drawing Figures

PNEUMATIC SKILL GAME

BACKGROUND OF THE INVENTION

This invention relates to a game of skill, and more particularly to a game in which a projectile confined within a section of transparent tubing is caused to move back and forth by manipulation of air bellows secured to the opposite ends of the tubing.

A pneumatic skill toy described in U.S. Pat. No. 2,919,135 comprises a section of transparent tubing having expandable air bladders, such as rubber balloons, secured to the opposite ends thereof, and a ball confined within the tubing for movement by air pressure in the tubing. In use, the air bladders are manipulated by the player to cause air currents to flow back and forth in the tubing to thereby move the ball captive therein. It is a closed system, so if air is moved in one direction through the tubing by collapsing one of the bladders, the ball is moved and at the same time the air expands the bladder at the opposite end, caution must be employed to prevent the resilient quality of the expanded bladder to direct the additional air therein backwardly through the tubing to alter the position of the ball therein. The object of the game which may be played with the toy, by one or two persons, is to position the ball progressively through several locations marked by indicia on the tubing. There is no clear indication of the winner, when the toy is used by two persons, visual observance of the position of the ball being the only way of noting the progress of the game.

SUMMARY OF THE INVENTION

It is a primary object of the present invention to provide a game to be played by two persons in competition which is both entertaining and useful in the development of manipulative skills, and in which the skill of the opposing players largely determines the outcome of the game.

Briefly, the game apparatus includes a section of rigid, transparent tubing which forms a relatively long, straight air passageway having compressible air bellows secured to its opposite ends, and a projectile, in the nature of a "shuttle cock", having a diameter slightly less than the inner diameter of the tubing, disposed within the tubing for movement therealong by air pressure within the tube. The air bellows is shaped to be firmly supported on a flat surface, and to be manipulated by one or both hands and is coupled to the tubing by an elbow connector. Associated with each of the bellows is a scoring indicator in the form of a flag which is actuable when the projectile strikes it. The object of the game is for one player to force the shuttle cock, by skillful manipulation of his bellows and in the face of manipulation by his opponent of his bellows, to strike the scoring indicator at the opponent's end of the tubing, the game being won by the player who scores the most times in a prearranged number of encounters. A count indicator is provided at each end of the tubing to keep a count of the "hits" scored by each of the players.

BRIEF DESCRIPTION OF THE DRAWINGS

The above and other objects and features of the invention will become more apparent, and its construction and operation better understood, from the following detailed description of a preferred embodiment, taken in conjunction with the accompanying drawings, in which.

DESCRIPTION OF THE PREFERRED EMBODIMENT

Figures 1, 2:
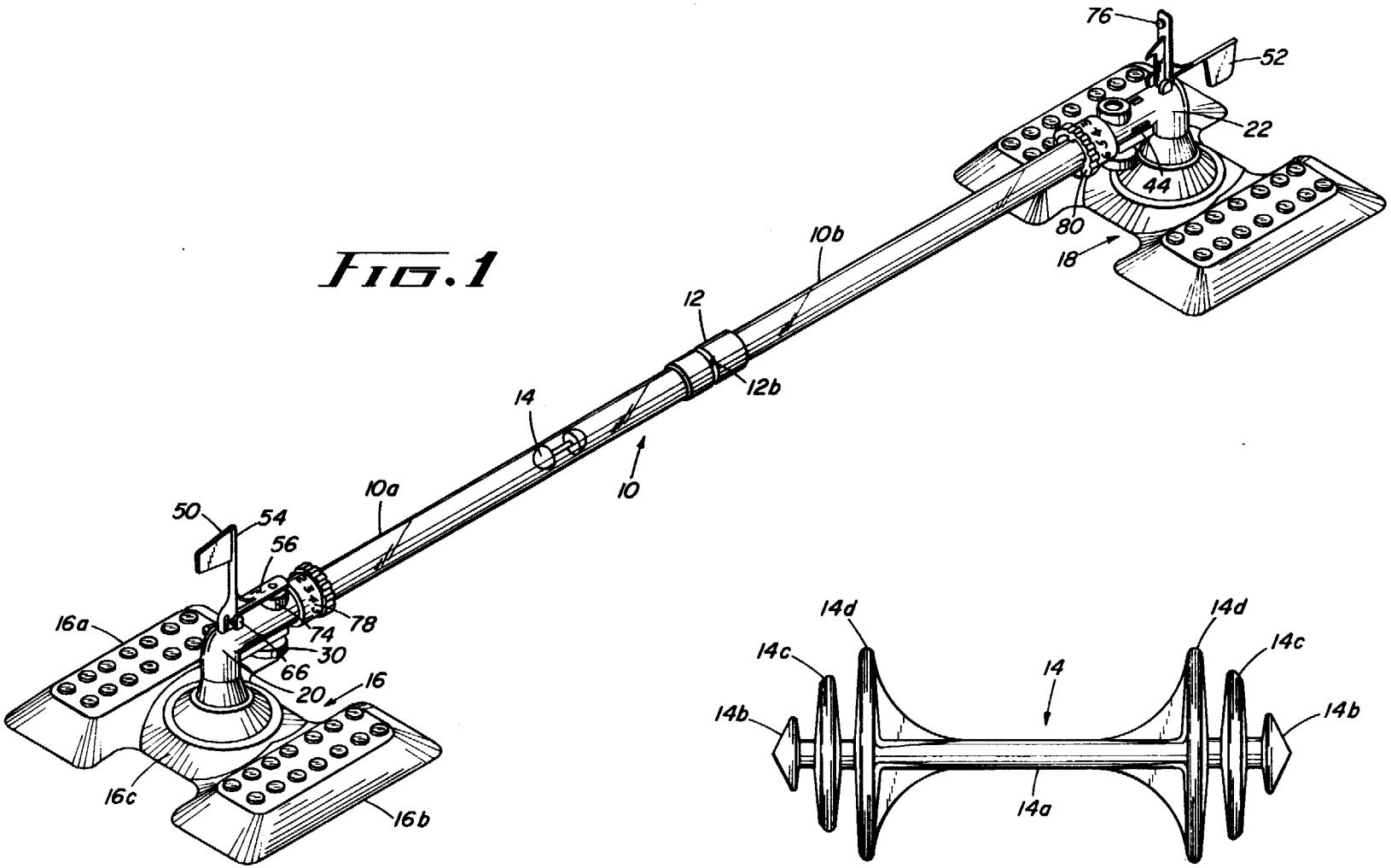
FIG. 1 is a perspective view of a pneumatic game device constructed in accordance with the invention.
FIG. 2 is a side elevation view of a projectile used in the device of FIG. 1.
Figure 3:
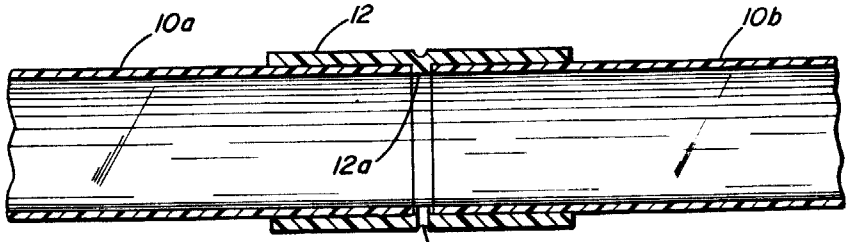
FIG. 3 is a fragmentary cross-sectional view of a tube connector member.

Referring now to FIG. 1, the game apparatus of the invention comprises a straight, elongated rigid transparent tube 10, typically having an outer diameter of 1 inch and an overall length of about 4 feet. In order that the packaging for the game be of reasonable size, the tubing preferably is in two sections 10*a* and 10*b* of substantially equal length and joined together by a center connector 12 formed, for example, of high impact plastic material. The inner diameter of the connector is dimensioned to receive the mating ends of the two tube sections with a snug fit, and as best seen in FIG. 3, has an internal peripheral shoulder 12*a* equidistant from its ends against the opposite sides of which the adjacent ends of the tube sections 10*a* and 10*b* abut. A connector length of about 2 inches has been found sufficient to securely join the tube sections and to prevent the joined tube from sagging at the middle. The connector has an air vent 12*b* formed in the wall thereof, at the location of the shoulder 12*a* so as to be disposed between the confronting ends of the tube sections, for relieving the air pressure within the tube, for reasons to be later described in more detail.

An elongated projectile 14, in the nature of a "shuttle cock" about 2 inches long, and having an outer diameter slightly less than the inner diameter of the tube 10, is disposed within the tube for movement back and forth therein by air pressure in the tube. The projectile is preferably molded from a suitable plastic material, and to reduce its weight while retaining the indicated overall dimensions, and to function cooperatively with other parts of the game apparatus (to be described), has the construction shown in FIG. 2, consisting of a central longitudinally extending shaft 14*a* having at each end thereof three integral, spaced-apart discs 14*b*, 14*c* and 14*d* of increasingly larger diameters whose peripheries lie along the arc of a circle, the diameter of the discs 14*d* being slightly less than the inner diameter of the tube 10.

Figure 4:
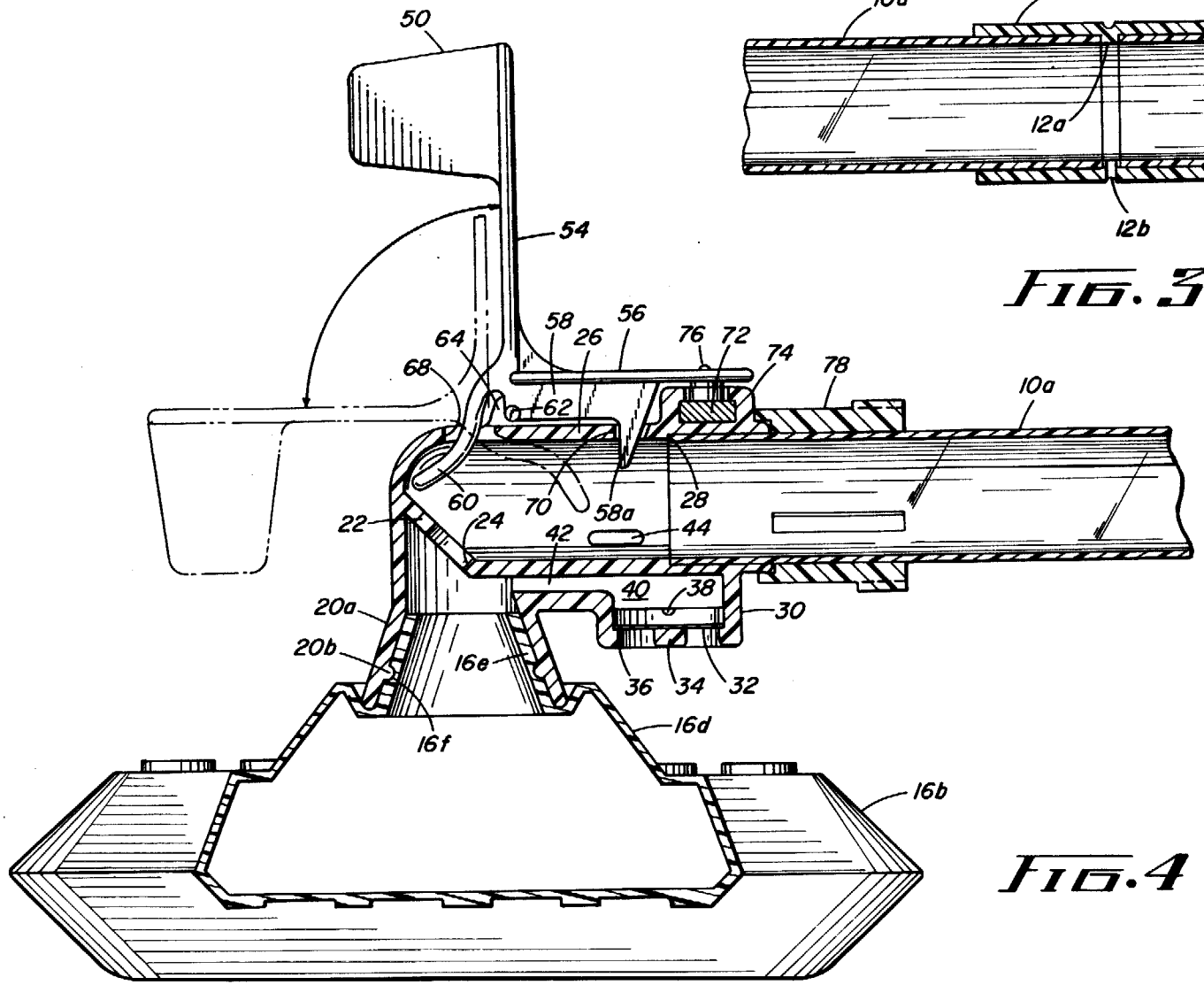
FIG. 4 is a fragmentary side elevation view, partially in cross-section, illustrating the construction of the bellows unit of the game apparatus.

The shuttle cock 14 is movable within the tube 10 by air currents produced by squeezing one or the other or both of two air bellows 16 and 18 coupled to and respectively communicating with the opposite ends of the tube 10 via elbow connectors 20 and 22. As best seen in FIG. 4, wherein the bellows 16 and the connector 20 are shown in cross-section, the bellows unit is a generally flat, hollow bladder formed to have two rectangular portions 16*a* and 16*b* coupled to each other through a cross-connecting portion 16*c*. The undersurfaces of the bladder portions 16*a* and 16*b* are flat so as to be stably supported on a floor or table or other supporting surface, and the underside of the cross-connecting portion is at a level slightly above the undersurface of portions 16*a* and 16*b*. The bellows unit is molded of a suitable flexible, durable plastic material, for example 50% medium density polyethylene and 50% linear polyethylene, so as to be hand squeezable by a child to drive the air from the bellows, yet be capable of springing back to a normal position when applied force is removed. The upper surfaces of the portion 16*a* and 16*b* have a plurality of circular projections formed thereon to be slightly simulative of a military weapon and to help prevent the hands of the user from slipping off when the bellows unit is being manipulated. Typically, the overall dimensions of the bellows unit are about 9 inches in the crosswise direction, about 6 inches in the direction parallel to the axis of tube 10 and about 1½ inches high.

Centrally of the upper surface thereof the cross-connecting portion 16*c* is of generally frustro-conical shape, as at 16*d*, and has a circumferential trough therearound for supporting the flared lower end 20*a* of the elbow connector 20, the inner diameter of which conforms to the outer diameter of the upper end 16*e* of the cone to effectively seal the elbow connector to the bellows unit. The elbow unit is removably secured to the bellows unit with a peripheral ring 20*b* of semicircular cross-section formed on the inner wall of the flared portion 20*c* which engages a correspondingly shaped and dimensioned peripheral groove 16*f* formed in the outer surface of the upper end 16*e* of the cone.

The elbow connector 20, which is preferably molded of plastic material such as ABS or HIS in two halves and joined at the section line illustrated in FIG. 4, has a transverse wall 22 having an aperture 24 therethrough which allows air to flow from the bellows, through the flared portion 20*a* and into the horizontally oriented barrel portion 26 and thence into the tube 10*a*, the inner end of which abuts against a shoulder 28 formed on the inner wall of the barrel inwardly from its free end. Integrally joined to the underside of the barrel 26 is a valve housing 30 of circular shape in which a thin, flexible disc 32 formed of vinyl, for example, is supported on a crossmember 34 extending diametrically across the housing 30, the lower end of the housing otherwise being open for the entry of air when the disc 32 is flexed and thereby lifted from the peripheral seat provided by the shoulder 36 formed on the inner wall at the lower end of the valve housing. When the interior pressure of the bellows unit is below atmospheric pressure, vertical movement of the disc is limited by another crossmember 38 extending from the inner wall and diametrically across the valve housing 30, above the disc 32. The space 40 above the disc communicates via a passage 42 with the flared lower end 20*a* of the elbow connector. Thus, when the air pressure within the system, which is closed except for the air vent 12*b* in the tube connector 12 and other openings in the elbow connector (to be described), is increased above atmospheric pressure by compressing the bellows unit, the flexible disc 32 is seated against the shoulder 36 to prevent the escape of air and to force air current to flow through the opening 24 into the barrel 26 and the tube 10. However, when the internal pressure of the system is below atmospheric, as happens upon release of the compressed bellows, the disc 32 flexes upwardly at its edges to allow air to enter the system. Thus, compression of bellows 16, if bellows 18 is not compressed at the same time, causes air to flow into tube 10 from left to right in FIG. 1 and to carry the shuttle cock 14 therealong until it enters the barrel portion of elbow connector 22. The converse is, of course, true if the bellows unit 18 is compressed when bellows 16 is not compressed. In actual game play, with opposing players pumping the bellows simultaneously, the shuttle cock is pressured back and forth since it is acted upon in both directions. Theoretically, if the opposing flows of air occur at the same instant and with the same force, the shuttle cock will remain stationary. A player wins by pumping with greater force than his opponent when the air flows are simultaneous, and/or by taking advantage of a "lull" in his opponent's pumping action, without which there is a resistance-free path to the scoring indicator. The object of the game is for each player to so manipulate his bellows unit as to prevent the shuttle cock from entering his unit and causing it to enter his opponent's unit, making for spirited competition and the development of proper coordination of eyes and hands to achieve the manipulative skill necessary to score against the opponent.

In order to ensure that the force exerted on the shuttlecock by actuation by one player of bellows 16, for example, to drive the shuttlecock toward the elbow connector 22 at the other end of the tube, be resisted only by air flow in the tube due to actuation of bellows 18 by an opponent, a pair of vents, one of which is visible at 44 in FIG. 4, are provided in the side walls of the elbow connectors, the vents each being about ¾ inch long and about 3/16 inch wide. Without such venting, the system would tend to "draw" the shuttlecock back slightly when the bellows is released and allowed to spring back to refill with air. Thus, the vents "fine tune" the air flow within the system and prevent the shuttlecock from being drawn back by a vacuum that would otherwise be present in the air passageway between the bellows and the shuttlecock.

The game's interest is heightened by a somewhat dramatic indication of a score provided by flags 50 and 52 mounted at the top of elbow connectors 20 and 22, respectively, which are actuable from the "down" position in which flag 52 is shown in FIG. 1 to the "up" position in which flag 50 is shown by entry of the shuttlecock into the barrel of the elbow connector. As better seen in FIG. 4, the flag and actuating assembly, which is preferably molded in a single piece from the same plastic material of which the elbow connector is formed, includes a staff 54 on which the flag 50 is supported, a thin, flat member 56 disposed perpendicularly to the staff and lying along the outer wall of the barrel 26, a flat septum 58 disposed along the center line of and depending from the under surface of member 56, a rearwardly extending curved member 60, and a pair of trunnions projecting from either side of septum 58, one of which is visible at 62. The trunnions are received in openings formed in a pair of bosses 64 and 66, and the curved member 60 extends through an opening 68 in the wall of barrel 26 and into the barrel, the relative locations of the pivot points and opening 64, and the curvature of member 60 being such as to permit the flag to freely pivot from the position shown in phantom to the position shown in full lines when the extremity of the curved portion, which is positioned essentially on the axis of barrel 26 when the flag is "down", is struck by the projectile 14. When the flag is pivoted to the "up" position, a hook 58*a* on septum 58 projects through an opening 70 in the wall of barrel 26 and into the barrel a sufficient distance to engage the inner surface of the disc 14*d* of the shuttlecock thereby to retain the shuttlecock within the barrel until the flag is returned to the "down" position. Inadvertent return of the flag to the "down" position is prevented by attraction of a permanent magnet 72 confined in a housing 74 formed on the topside of the barrel 26 to a magnetic member, such as a rivet 76, secured to the extremity of member 56 of the flag assembly. Thus, the flag must be deliberately lowered, following a score, to again put the shuttlecock in play for another encounter.

The players may keep track of their respective "hits" by scoring rings 78 and 80 rotatably mounted with a snug fit on the tube 10 adjacent the free end of the elbow connectors 20 and 22, respectively. These rings are preferably molded of high impact plastic material, are knurled to facilitate their rotation relative to the tube 10, and have indicia, such as 1, 2, 3, 4, etc., distributed therearound to indicate by alignment with a reference mark on the end of the barrel the number of "hits" scored. The player who scores the most "hits" in a prearranged number of encounters wins the game.

It will be evident from the foregoing that there is provided an entertaining competitive game which meets the objects of the invention. The invention resides in the combination and arrangement of parts and in the details of construction described and claimed, it being the intention to cover all changes and modifications of the example of the invention chosen for purposes of the disclosure which fall within the spirit and scope of the invention.

We claim:

1. Game apparatus comprising, in combination:

a section of transparent, rigid tubing of uniform diameter throughout its length, and having an air vent therein at about the midpoint of its length, a projectile of a diameter slightly less than the inner diameter of said tubing disposed within said tubing and movable therealong, a pair of bellows units connected one to each end of said section of tubing, each of which includes a compressible bladder shaped to be stably supported on a supporting surface, and an elbow connector for carrying air from said bladder to one end of said section of tubing and for supporting said tubing at a level above said supporting surface, whereby air displaced from one end of said bellows units will move said projectile toward the other of said bellows units, which movement will be resisted by air displaced from said other one of said bellows units, each of said elbow connectors having vents therein and a one-way valve for allowing air to enter the bellows unit when the air pressure therein is below atmospheric pressure, and a pair of indicator means operatively connected one to each of said elbow connectors for indicating entry of said projectile into the respective elbow connector.

2. Apparatus according to claim 1, wherein said indicator means comprises a flag structure pivotally supported on said elbow connector and including a member extending into said elbow connector, said flag structure being so arranged that when it is in a "down" position the member extending into the elbow connector is a position to be struck by entry of said projectile into the elbow connector whereby to pivot the flag structure to an "up" position.

3. Apparatus according to claim 2, wherein said projectile is an elongated, cylindrical member having a diameter at its ends slightly less than the inner diameter of said tubing and a smaller diameter intermediate the ends, and said flag structure further includes a hook arranged to project into said elbow connector when the flag structure is in its "up" position and to engage and retain said projectile within said elbow connector until the flag structure is returned to its "down" position.

4. Apparatus according to claim 3, wherein said indicator means further includes magnet means for maintaining said flag structure in its "up" position by magnetic attraction.

5. Apparatus according to claim 4, wherein said magnet means comprises:

a permanent magnet supported on said elbow connector, and a magnetic element supported on said flag structure in a position to be placed in proximity with said permanent magnet when said flag structure is in its "up" position.

6. Apparatus according to claim 1, further including a pair of annular rings each having an inner diameter substantially equal to the outer diameter of said tubing, one rotatably supported on said tubing at each end thereof adjacent a respective elbow connector, said rings having indicia thereon for indicating the game score by alignment with a reference mark.

7. Apparatus according to claim 1, wherein said projectile is an elongated member consisting of a central, longitudinally extending shaft to which are integrally joined near each end thereof a plurality of like spaced-apart discs of differing diameters, the diameter of the largest disc at each end being slightly less than the inner diameter of said tubing.

* * * * *